US006030239A

United States Patent [19]

Liu

[11] Patent Number: 6,030,239

[45] Date of Patent: Feb. 29, 2000

[54] EDGE CARD CONNECTOR

[76] Inventor: Chin Ching Liu, No. 25,Lane 16, Tung Hsing St., Shu Lin Chen, Taipei Hsien, Taiwan

[21] Appl. No.: 09/166,152

[22] Filed: Oct. 5, 1998

[51] Int. Cl.[7] ..... H01R 13/62

[52] U.S. Cl. ..... 439/160; 439/157

[58] Field of Search ..... 439/157, 155, 439/160, 152, 153, 154, 156, 158, 159

[56] References Cited

U.S. PATENT DOCUMENTS

| | | | |
|---|---|---|---|
| 5,147,211 | 9/1992 | Tondreault et al. | 439/160 |
| 5,232,374 | 8/1993 | Iino | 439/157 |
| 5,571,025 | 11/1996 | Arai et al. | 439/160 |
| 5,672,069 | 9/1997 | Cheng et al. | 439/160 |
| 5,690,499 | 11/1997 | Howell et al. | 439/157 |

*Primary Examiner*—Paula Bradley
*Assistant Examiner*—Tho D. Ta
*Attorney, Agent, or Firm*—Dougherty & Troxell

[57] ABSTRACT

This invention relates to an edge card connector, the edge card connector being composed of a connector, an edge card and one or more turning arms. The connector has an inserting groove for installing the edge card, the turning arm being installed at one or two sides of the connector. The turning arm has a pushing part and an arc seat, the pushing part can push out the edge card from the inserting groove when the turning arm is rotated upwardly. The arc seat can slide into the arc groove of the connector to allow the turning arm to rotate within a setting angle around the arc seat. At the side of the connector is an elastic vertical plate having a stopping face formed at its bottom. The arc seat is situated under the stopping face, such that, the end of vertical plate is pressed inwardly by the arc seat when inserting the turning arm into the arc groove.

7 Claims, 9 Drawing Sheets

EDGE CARD CONNECTOR

BACKGROUND OF THE INVENTION

1. Field of the Invention

This invention relates to an edge card connector, especially an edge card connector having pivoted turning arms which can push out an edge card from an inserting groove of the connector and prevent the connector body from breaking when inserting the edge card or turning arms.

2. Description of the Prior Art

The conventional edge card connector is used to push out the edge card installed in the inserting groove of a connector quickly.

Two ends of the conventional edge card connector have respectively two extension walls, between the two extension walls is a locating groove, a turning arm being installed in the locating groove for pushing out the edge card. Generally speaking, the edge card is very thin and long and has many contacts, thus the connector body usually has two leading parts formed at its two ends for leading the edge card into the correct position in the connector to ensure the contacts of edge card accurately touch the terminals installed in the connector. The leading part is composed of a vertical plate having a longitudinal groove, between the two extension walls having a side plate, such that, the edge card can be inserted into the inserting groove accurately along the two parallel longitudinal grooves.

The conventional edge card connectors have some deficiencies, two sides of the turning arm having respectively a fixing shaft, such that, the fixing shafts may drag the side plate to break when pushing the fixing shafts of the turning arm into the fixing holes on the extension walls to locate the turning arm. Furthermore, two sides of the turning arm touch the inner wall of the extension walls, such that, the extension walls may be deformed by the frequent rocking of the turning arm. Accordingly, the conventional edge card may be broken in the installing procedure.

SUMMARY OF THE INVENTION

It is therefore the main object of this invention to provide an edge card connector having turning arms installed at one or two sides for pushing out the edge card from the inserting groove of connector, the connector having an elastic vertical plate and an arc groove formed at one or two sides, such that, the turning arms can slide into position between the stopping face of the vertical plate and the arc groove and rotated abounded the pivoted point freely. Thus the edge card connector cannot be broken in installing procedure.

BRIEF DESCRIPTION OF THE DRAWINGS

In the drawings, which illustrate the preferred embodiments and modes of operation of the invention, and in which like reference characters designate the same or similar parts throughout the several views.

DETAILED DESCRIPTION OF THE PREFERRED EMBODIMENTS

Figure 1:
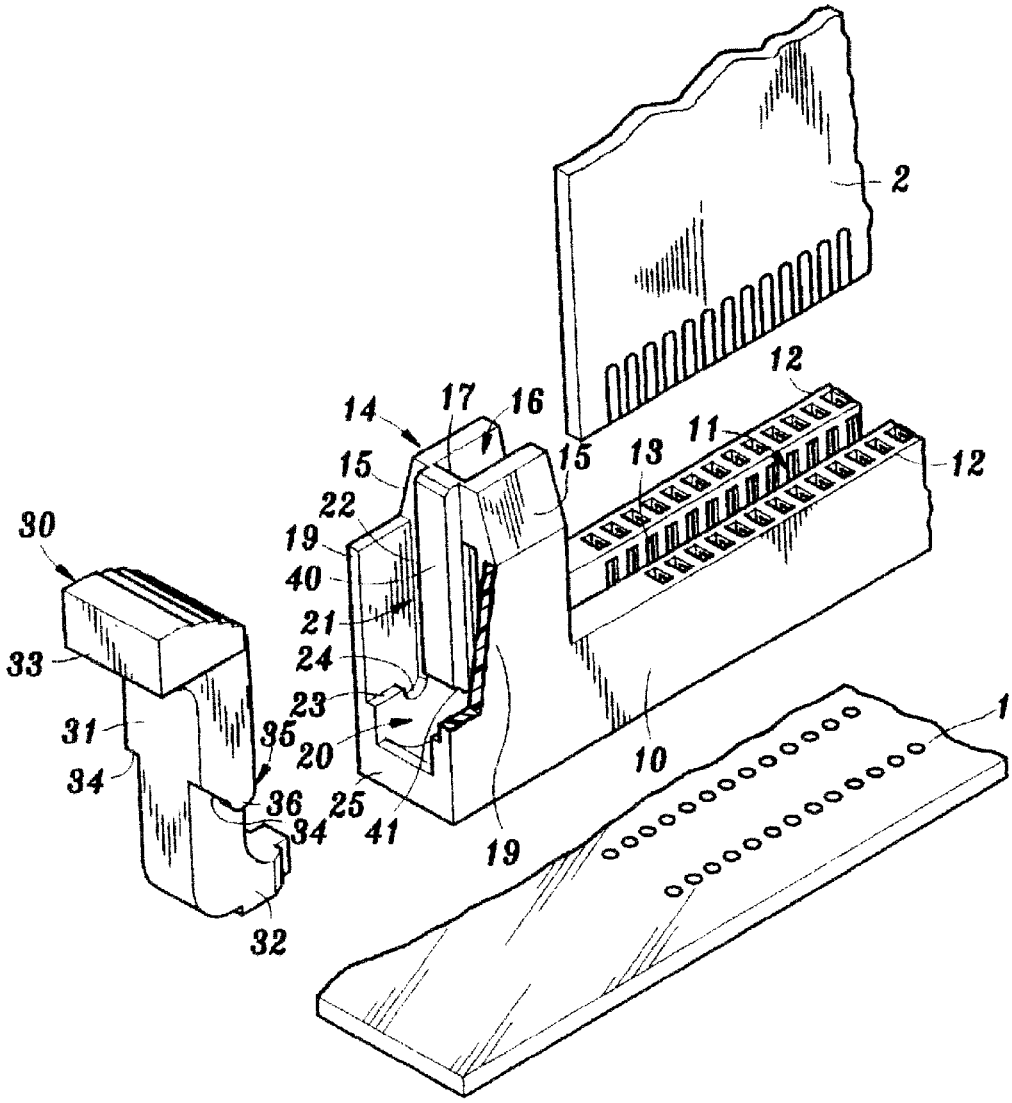
FIG. 1 is an exploded view showing an edge card connector of my present invention.

Referring to FIG. 1, the present invention, an edge card connector, is composed of a connector 10 and an edge card 2. The connector 10 is made of non-conducting material, the center of this connector 10 having an inserting groove 11 for inserting the edge card 2. The connector surfaces at two sides 12 of the inserting groove 11 have a plurality of opposite fixing grooves 13 for inserting terminals into the opposite fixing grooves 13. The connector 10 is installed on an printed circuit board 1 to enable the edge card 2 to be connected with the circuit of this printed circuit board 1.

Two ends of the connector 10 have a leading part 14 for leading the edge card 2 into the inserting groove 11. The leading part 14 is composed of two first extension walls 15, the space between the first extension walls 15 forming a leading groove 16 perpendicular to the inserting groove 11. The tops of two first extension walls 15 having a side plate 17. The width of leading groove 16 is equal nearly to the thickness of edge card 2, furthermore, the distance between two plates 17 being equal nearly to the width of edge card 2, such that, the edge card 2 can be led and located into the inserting groove 11 accurately by means of the leading parts 14.

The connector 10 has two second extension walls 19 extending from the end of first extension walls 15, the space between the bottoms of the two second extension walls 19 forming a locating groove 20 being connected to the inserting groove 11. Between the leading groove 16 and the locating groove 20, a vertical plate 40 extends from the side plate 17, between the two second extension walls 19 and the vertical plate 40 forming a fitting groove 21 situated above the locating groove 20. Furthermore, between the front side wall 22 and the bottom side wall 23 is an arc groove 24.

Figure 2:
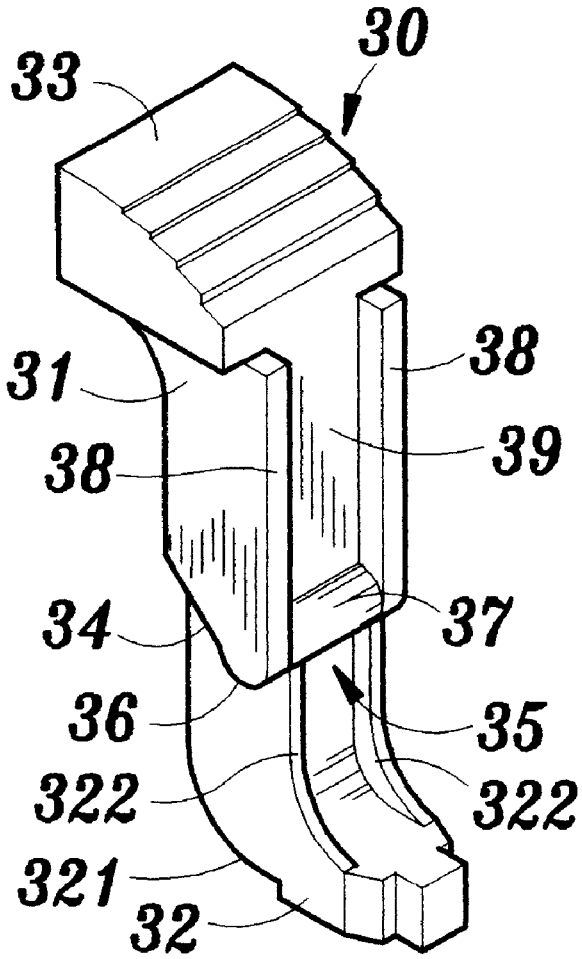
FIG. 2 is a perspective view showing the assembled edge card connector of this invention.

Referring to FIG. 2, turning arms 30 are installed respectively on two sides of the connector 10. The turning arm 30 is composed of an arm body 31, a hook shape pushing part 32 and a pressing part 33, wherein the pressing part 33 extends from the top of arm body 31. A top surface of the pressing part 33 has a plurality of non-skid stripes for the user to rotate the turning arm 30. The width of arm body 31 is larger slightly than the width of pushing part 32 and has an inclined face 34. The end of inclined face 34 has an arc seat 35, two sides of the arc seat 35 having arc parts 36, and between the two arc parts 36 having a convex arc 37.

Figure 3:
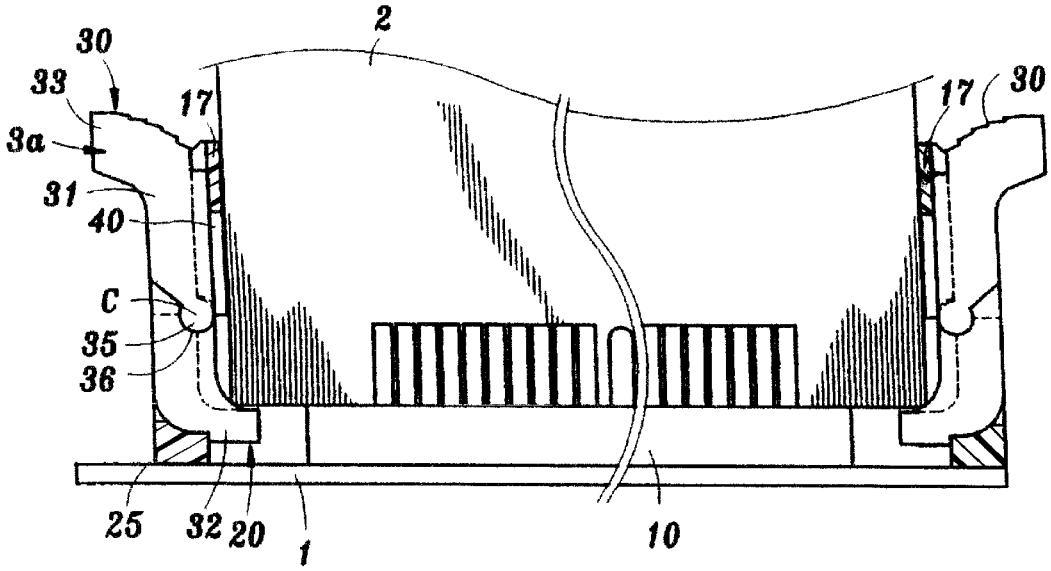
FIG. 3 is a partial sectional view of this invention.
Figure 4:
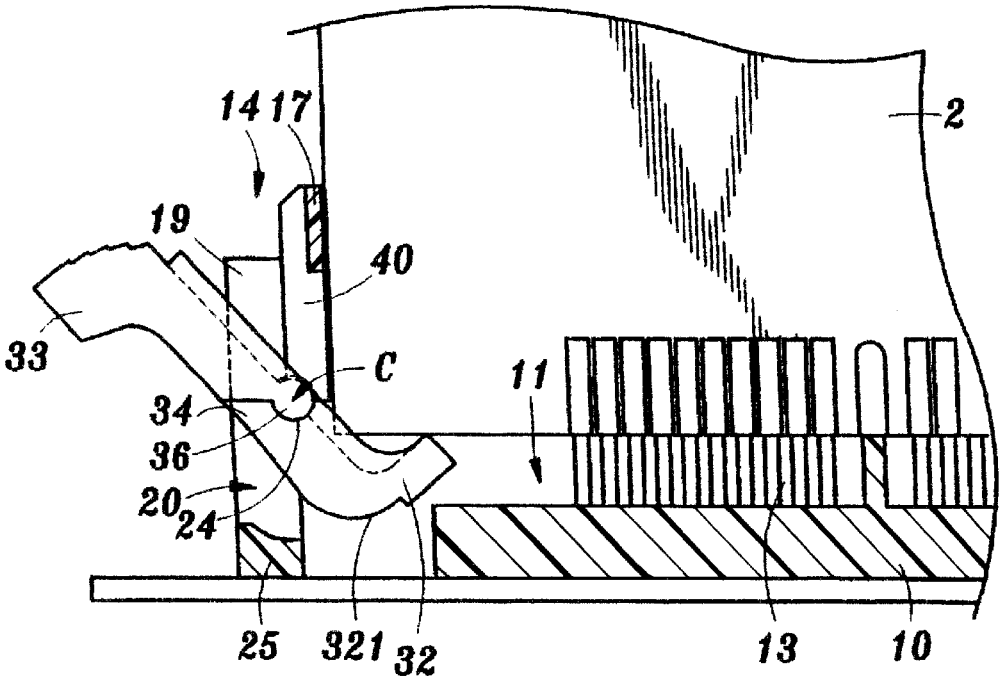
FIG. 4 is a partial sectional view showing the pushed edge card of this invention.

Referring to FIG. 3, the arc parts 36 of turning arm 30 are installed in the arc grooves 24 of connector 10 as the turning arm 30 is inserted into the second extension walls 19. Furthermore, the pushing part 32 is inserted into the locating groove 20, such that, the turning arm 30 can be rotated around the central line "c". As the edge card 2 is inserted into the inserting groove 11, the turning arms 30 will be located in a first position shown in FIG. 3 to make the pushing parts 32 touch the bottom of edge card 2. If the operator rotates the turning arms 30 from the first position to a second position shown in FIG. 4, the pushing parts 32 of the turning arms 30 will push out the edge card 2 upwardly.

The inclined face 34 of turning arm 30 will be stopped by the bottom sidewall 23 when the turning arm 30 rotates to the second position so as to make the turning arm 30 rotate within a setting angle.

Figure 5:
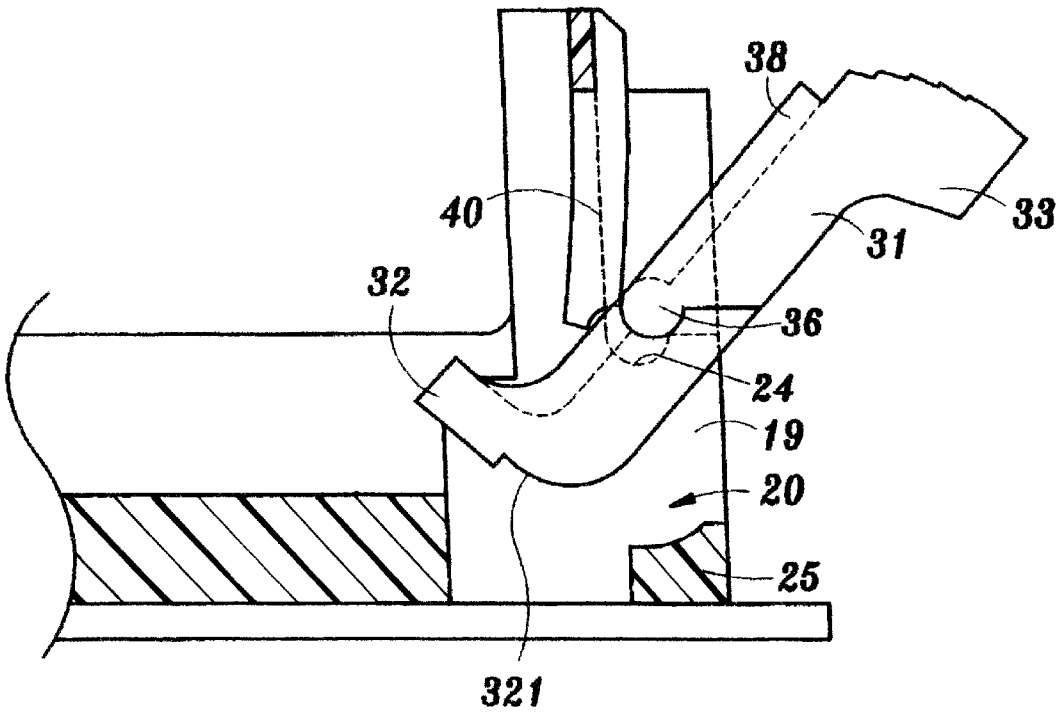
FIG. 5 is a partial sectional view showing the assembling and disassembling operation of the turning rod of this invention.

Referring to FIG. 1 and FIG. 2, the vertical plate 40 has a stopping face 41, the convex arc 37 of turning arm 30 is installed under the stopping face 41 so as to prevent the arc seat 35 moving upwardly. Referring to FIG. 5, the vertical plate 40 is made of elastic material, such that, the bottom of vertical plate 40 may be pressed inwardly by the arc seat 35 when the arc seat 35 is inserted into the arc groove 24.

Accordingly, the operator can install the turning arm 30 with a slanted angle into the space between two second extension walls 19, while the arc seat 35 presses the bottom of vertical plate 40 inwardly and slides into the arc groove 24. Furthermore, the vertical plate 40 will return to its original position when the arc seat 35 slides into the arc groove 24 so as to locate the arc seat 35 between the arc groove 24 and the stopping face 41. On the other hand, the turning arm 30 can be taken out from the arc groove 24 by pressing the end of vertical plate 40 inwardly to take out the turning arm 30, such that, the connector 10 and side plate 17 would not be broken when installing the turning arm 30 into the connector 10.

Two front sides of the turning arm 30 have parallel convex strips 38, between the two parallel convex strips 38 is a locating recess 39, the width of this locating recess 39 is equal nearly to the width of vertical plate 40, such that, the locating recess 39 can be fitted with the vertical plate 40 when the turning arm 30 is located on the first position to prevent the turning arm 30 from rocking left or right.

Figure 6:
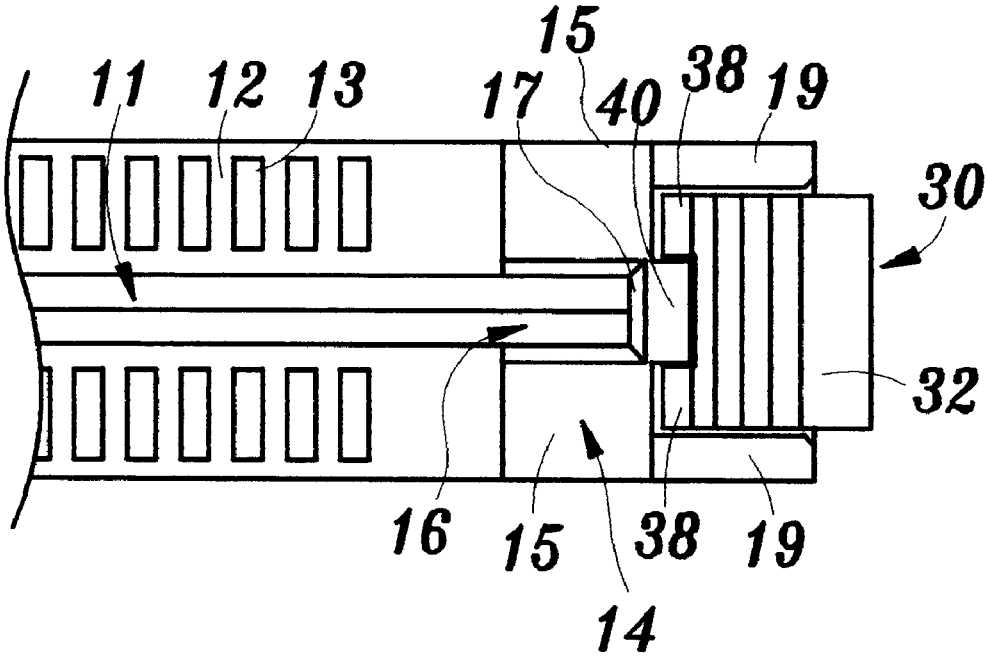
FIG. 6 is a partial top plan view of this invention.

The vertical plate 40 not only locates the turning arm 30 but also prevents the side plate 17 from breaking. Please refer to FIG. 6, the width of vertical plate 40 being bigger than that of leading groove 16, i.e. two sides of the vertical plate 40 being connected with the two first extension walls 15 so as to enforce the strength of the top of first extension walls 15 so as to enforce the strength of top of first extension walls 15 and the side plate 17.

In addition, inside the locating groove 20 is a connecting block 25 for connecting the two second extension walls 19 to enforce the strength of the two second extension walls 19. The bottom of turning arm 30 is cut at a slant angle 321, such that, the connecting block 25 can be designed with more thickness to prevent it from breaking during installation of the edge card 2. In addition, the pushing part 32 has two enforcing ribs 322 formed at its two sides so as to enforce the strength of pushing part 32.

Figure 7:
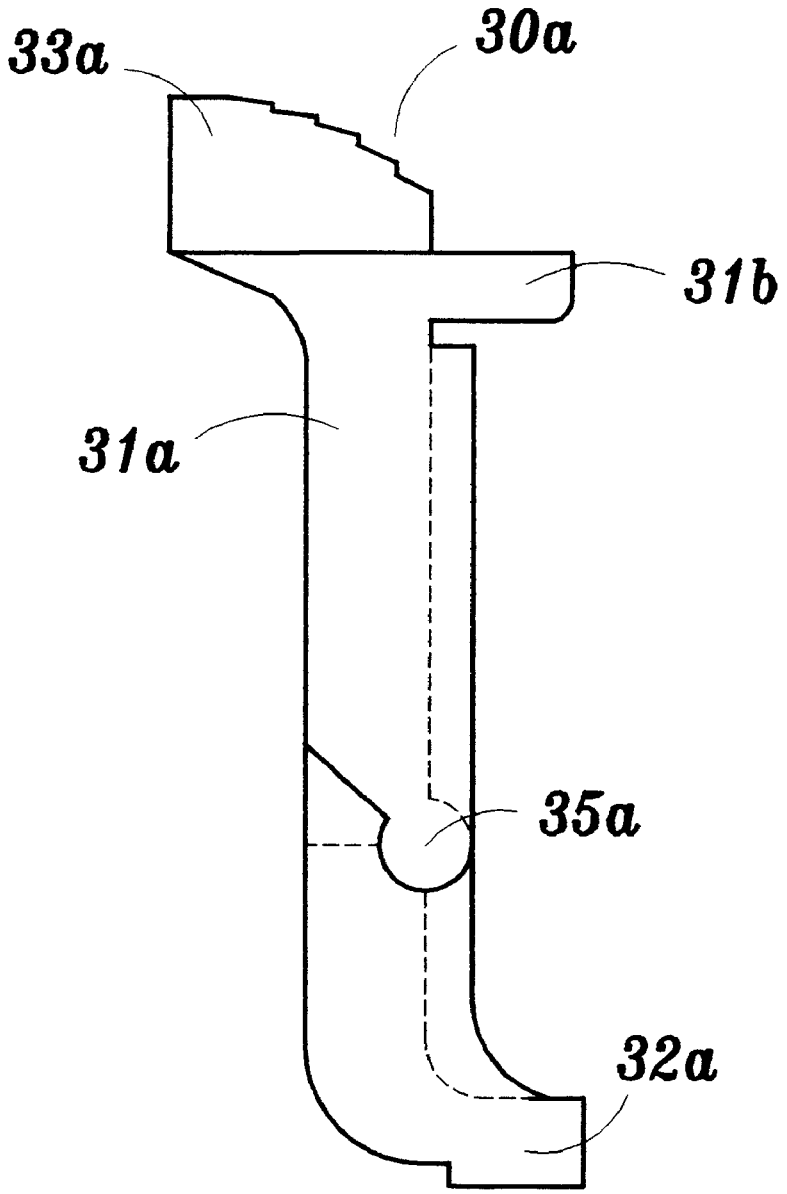
FIG. 7 is side plan view showing another embodiment of this invention.
Figure 8:
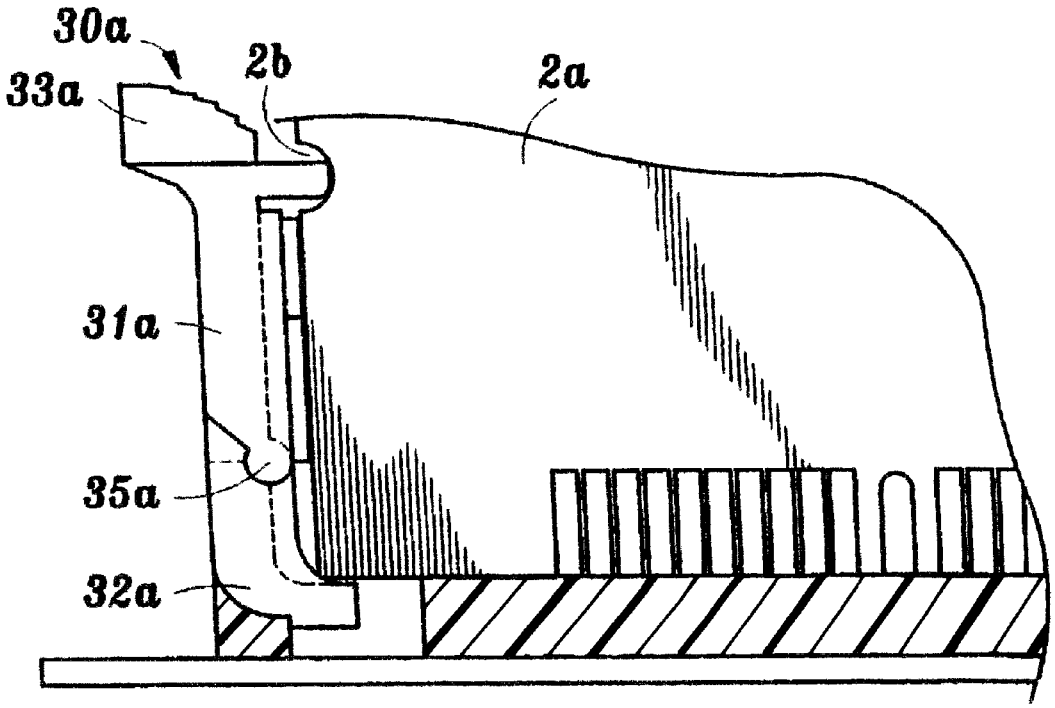
FIG. 8 is a partial sectional view of the embodiment of FIG. 7.

FIG. 7 and FIG. 8 show another embodiment of this invention, the turning arm 30*a* in this embodiment being composed of a body 31*a*, a hook pushing part 32*a* and a pressing part 33*a*, wherein the length of this turning arm 30*a* is longer than that of the turning arm 30 in first embodiment. Furthermore, the top of the turning arm 30*a* has a fixing post 31*b* which can be inserted into the fixing hole 2*b* on edge card 2*a* so as to firmly locate the edge card 2*a*.

Figure 9:
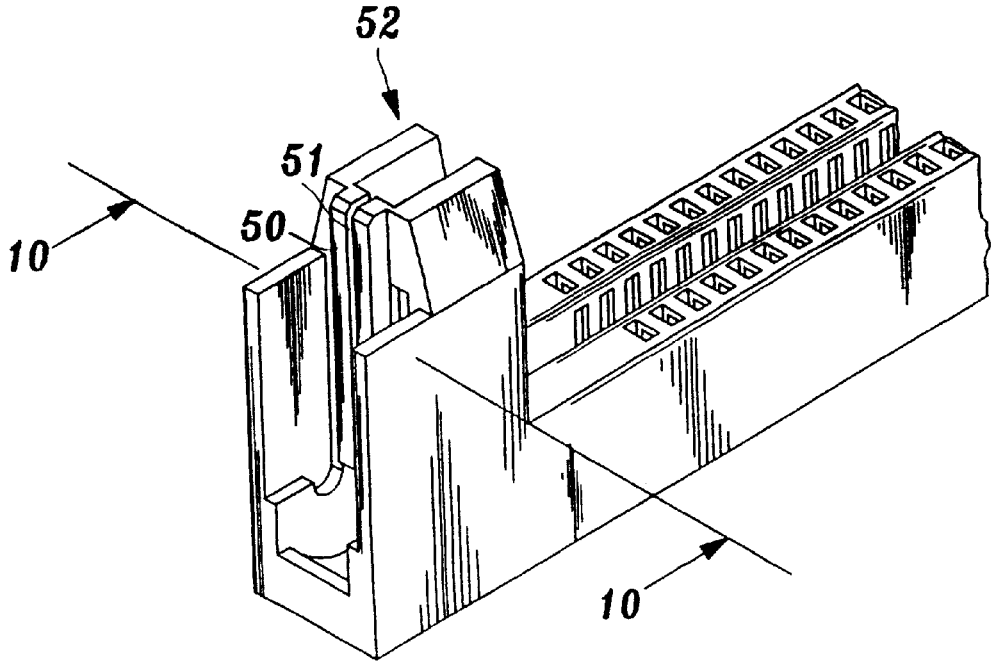
FIG. 9 is a perspective view showing still another embodiment of this invention.
Figure 10:
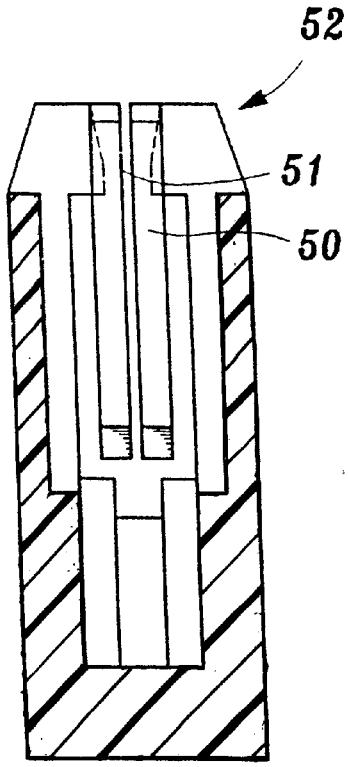
FIG. 10 is a side plan view of the embodiment in FIG. 9.

The FIG. 9 and FIG. 10 show still another embodiment of this invention. The vertical plate 50 in this embodiment has a longitudinal aperture 51 formed at its center so as to give the leading part 52 better elasticity and to match different edge cards.

The device, as described herein, is exemplary and it is apparent that those skilled in the art may make various modifications therein without departing from the scope of the invention, as defined in the ensuing claims.

What is claimed is:

1. An edge card connector comprising:

a connector having an inserting groove for installing an edge card, two ends of the connecting having respectively two first extension walls and two second extension walls, said two second extension walls extending from said two first extension walls, a locating groove being formed between bottoms of the two second extension walls, said locating groove connected to the inserting groove, furthermore, an inner face of each second extension wall having an arc groove;

at least one turning arms, the turning arms being pivoted at said one or two ends of said connector and can be rotated within setting angle around pivoted point, said turning arm having a pushing part and an arc seat, wherein each side of said arc seat forming an arc part, the pushing part being inserted into said locating groove and adapted to eject the edge card from said inserting groove as rotating the turning arm upwardly, each arc part adapted to slide into said arc groove;

at least one vertical plate situated between said two second extension walls to form a fitting groove situated above said locating groove, bottom of said vertical plate having a stopping face for stopping said turning arm from moving upwardly; said stopping face being pressed inwardly into the direction of the inserting groove by said arc seat when said arc part being slidingly mounted into said arc groove.

2. An edge card connector as claimed in claim 1, wherein the vertical plate is made of an elastic material.

3. An edge card connector as claimed in claim 1, wherein the turning arm is composed of a body, the pushing part and a pressing part, the pressing part being extended from a top portion of said arm body, two front sides of the body having two parallel convex strips, between the two parallel convex strips having a locating recess, said vertical plate can be fitted into the locating recess to prevent turning arm from rocking at left and right side.

4. An edge card connector as claimed in claim 1, wherein said arc seat defines a convex arc, the convex arc being situated under the stopping face of the vertical plate.

5. An edge card connector as claimed in claim 1, wherein the turning arm has a slant angle at its bottom.

6. An edge card connector as claimed in claim 1, wherein the turning arm has a fixing post formed at its upper part, the fixing post can be inserted into a fixing hole on said edge card to locate the edge card firmly.

7. An edge card connector as claimed in claim 1, wherein the vertical plate has a longitudinal aperture formed at its center to provide better elasticity.

* * * * *